US007878189B2

(12) United States Patent
Lee et al.

(10) Patent No.: US 7,878,189 B2
(45) Date of Patent: Feb. 1, 2011

(54) COMBUSTION FAN INSTALLATION STRUCTURE OF GAS RADIATION OVEN RANGE

(75) Inventors: Dae-Rae Lee, Gyungssangnam-Do (KR); In-Gyu Kim, Gyungsangnam-Do (KR); Dae-Hee Jung, Gyungsangnam-Do (KR); Sug-Moon Choung, Gyungsangnam-Do (KR); Yang-Ho Kim, Gyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 557 days.

(21) Appl. No.: 10/536,394

(22) PCT Filed: Nov. 29, 2002

(86) PCT No.: PCT/KR02/02244

§ 371 (c)(1),
(2), (4) Date: May 26, 2005

(87) PCT Pub. No.: WO2004/051144

PCT Pub. Date: Jun. 17, 2004

(65) Prior Publication Data

US 2006/0070616 A1 Apr. 6, 2006

(51) Int. Cl.
*F24C 15/20* (2006.01)

(52) U.S. Cl. ..... 126/299 D; 126/21 A; 126/80

(58) Field of Classification Search ..... 126/300, 126/301, 302, 303, 312, 21, 20.1, 80, 307, 126/299 R, 307 R, 39 K, 15 A, 19 R, 21 A, 126/61, 66, 71
See application file for complete search history.

(56) References Cited

U.S. PATENT DOCUMENTS

| | | | | | |
|---|---|---|---|---|---|
| 2,617,404 | A | * | 11/1952 | Prather | 126/39 K |
| 2,762,360 | A | * | 9/1956 | Knoy | 126/21 R |
| 3,468,298 | A | * | 9/1969 | Walter, Jr. et. al. | 126/39 J |
| 4,018,553 | A | * | 4/1977 | Baker et al. | 431/7 |
| 4,020,821 | A | * | 5/1977 | Reid et al. | 126/39 E |
| 4,024,839 | A | * | 5/1977 | Reid et al. | 126/39 J |
| 4,428,357 | A | * | 1/1984 | Field | 126/299 R |
| 4,951,646 | A | * | 8/1990 | Diekmann et al. | 126/39 J |
| 4,957,096 | A | * | 9/1990 | Yokoyama | 126/39 H |
| 5,209,217 | A | * | 5/1993 | Beach et al. | 126/39 R |
| 5,406,932 | A | * | 4/1995 | Joseph et al. | 126/39 K |
| 5,509,403 | A | * | 4/1996 | Kahlke et al. | 126/39 E |
| 5,979,429 | A | * | 11/1999 | Schultheis et al. | 126/39 G |

FOREIGN PATENT DOCUMENTS

| | | | |
|---|---|---|---|
| DE | 4326945 A1 | | 2/1995 |
| GB | 2267750 | * | 5/1993 |
| GB | 2267750 | * | 12/1993 |

* cited by examiner

*Primary Examiner*—Alfred Basichas
(74) *Attorney, Agent, or Firm*—Birch, Stewart, Kolasch & Birch, LLP

(57) ABSTRACT

A combustion fan installation structure of a gas radiation oven range is disclosed in which a combustion fan (200) is coupled at a space outside a space where a radiant burner (40) is positioned. Since the temperature of the sucked air for combustion is constantly maintained, an air with a sufficient air density can be supplied. Thus, it can have a stable combustion performance. In addition, an influence of the temperature change generated when the oven or the grill is operated can be excluded. Accordingly, a reliability of a combustion performance of the gas radiation oven range to be mainly used in kitchens or in hotels can be improved.

9 Claims, 6 Drawing Sheets

COMBUSTION FAN INSTALLATION STRUCTURE OF GAS RADIATION OVEN RANGE

TECHNICAL FIELD

The present invention relates to a gas radiation oven range, and more particularly, to a combustion fan installation structure of a gas radiation oven range that is capable of improving a combustion performance of a gas radiation oven range and maintaining a better combustion form by supplying air with enough and uniform oxygen density in a gas radiation oven range having a combustion fan supplying air.

BACKGROUND ART

In general, a gas radiation oven range heats a radiator and cooks a foodstuff by using a radiant heat radiated from the heated radiator.

FIG. 1 illustrates an example of a gas radiation oven range in accordance with a conventional art.

As shown in FIG. 1, the gas radiation oven range (C) is formed in a hexahedral shape, including a top burner unit (TB) in which a plurality of burners are coupled to heat a container with a foodstuff therein is installed at the top layer of the burner, a grill unit (G) for making baked foodstuffs by using heat convection installed at a lower side of the top burner unit (TB), and an oven unit (O) for cooking a barbecue cuisine by using a vertical direct-fire power and heat convection installed at a lower side of the grill unit (G).

The top burner unit (TB) includes: an outer case 10 formed to have a certain internal space with its upper side opened; a ceramic glass 20 coupled at the upper side of the outer case 10 to cover it, on which a foodstuff is placed; a burner housing 30 coupled to be in contact with a lower surface of the ceramic glass 20 and forming an exhaust passage (F) together with the lower surface of the ceramic glass 20; and a radiant burner 40 coupled at one side of the burner housing 30 and generating a radiant wave while combusting a mixed gas.

An air suction hole 11 is formed at a front side into which air is introduced, and an exhaust port 12 is provided at a rear side of the burner.

The ceramic glass 20 is formed to have an area to cover the upper end of the outer case 10 and a certain thickness and made of a material that can transmit a radiant wave generated from the radiant burner 40.

A cooking area (A) is indicated at an upper side of the ceramic glass 20 so that a foodstuff can be placed at the position where the radiant wave radiated from the radiant burner 40 is transmitted.

As shown in FIG. 2, the burner housing 30 includes: a lower plate unit 31 formed having a certain width and length; side plate units 32 bent and extended in a vertical direction at both sides of the lower plate unit 31; a connection plate unit 33 extended and bent so as to connect the both side plate units 32 to one side of the lower plate unit 31; a coupling face unit 34 extended and bent in a horizontal direction from the end of the both side plate unit 32 and the connection plate unit 33 and having a certain area; and a mounting hole 35 positioned at the side of the air suction hole 11 of the outer case 10 and penetratingly formed so that the radiant burner 40 is mounted at one side of the lower plate unit 31

The connection plate unit 33 of the burner housing 30 is positioned at a front side of the outer case 10, and the opposite opened portion is positioned at the rear side of the outer case 10.

As the coupling face unit 34 is coupled being in contact with the lower surface of the ceramic glass 20, the exhaustion passage (F) for exhausting a combustion gas and the convection heat is formed together with the lower plate unit 31, the both side plate units 32 and the lower surface of the ceramic glass 20.

The radiant burner 40 is fixedly coupled so that a burner head 41 forming a mixing chamber (M) is positioned at the mounting hole 35 of the burner housing 30.

A mixed gas pipe 44 is coupled at one side of the burner head 41, and a burner mat 42, a radiator for radiating a radiant wave, is fixedly coupled at an upper side of the burner head 41 so as to cover the mixing chamber (M) as the gas mixed in the mixing chamber (M) is discharged, burned and heated.

An ignition and inflammation detecting unit 43 for igniting a mixed gas belched through the burner mat 42 and detecting a combustion state of the mixed gas is coupled at the lower plate unit 31 of the burner housing 30 so as to be adjacent to the burner mat 42.

The combustion fan 46 and a fan housing with a fan motor 47 inserted therein are coupled to communicate with the mixed gas pipe 44.

As shown in FIG. 3, the mixed gas pipe 44 is coupled protruded inside the radiant burner 40.

The radiant burner may be constructed by having a plurality of assembly of the burner housing 30 and the radiant burner 40 according to its use and size.

The operation of the gas radiation oven range will now be described.

First, a cooking container 50 with a foodstuff therein is placed on a cooking area (A) of the ceramic glass 20, and then, the gas radiation oven range is operated.

Then, as the combustion fan 46 is rotated, an external air is sucked through the air suction hole 11 and introduced into the mixed gas pipe 44 through the fan housing 45, and at the same time, a separately supplied gas is supplied to the mixed gas pipe 44 and mixed with the air. The mixed gas is discharged through the burner mat 42, and at the same time, ignited and burned by an ignition flame generated by the ignition and inflammation detecting unit 43.

At this time, as the mixed gas is belched through the burner mat 42 and at the same time burned, the burner mat 42 is heated and radiates a radiant wave. The radiant wave radiated from the burner mat 42 is transmitted through the ceramic glass 20 to heat the cooking container 50, thereby cooking the foodstuff put therein.

The combustion gas and convection heat generated as the mixed gas is burned flow at a certain flow rate along the exhaustion passage (F) formed by the ceramic glass 20 and the burner housing 30 and are exhausted outside the gas radiation oven range through the exhaust port 12 formed at the rear side of the outer case 10.

The conventional gas radiation oven range uses two burners, showing structures of each component.

In general, if a mixture ratio between a fuel and an air is not constant, a combustion state is unstable in a mixed combustion.

That is, in the gas radiation oven range which cooks a foodstuff by using the radiant heat generated when a gas is burned around the burner mat 42, the combustion state works as a critical parameter in generating the radiant heat.

However, since the combustion fan 46 is adjacent to the side of the radiant burner 40, the air supplied to the combustion fan 46 typically has a higher temperature than that of the general room air.

In this respect, if the temperature of the air goes up, its oxygen density contained in the air is lowered down, failing to supply an air sufficient for combustion.

Then, combustion is incompletely made, and accordingly, when the mixed gas is burned in the burner mat 42, the burner mat 42 is not sufficiently heated, resulting in that a radiant wave of a short wavelength suitable for cooking can not be generated.

Resultantly, since the combustion is not completely made in the gas radiation oven range, the cooking performance of the burner is considerably degraded.

In other words, the increase in the temperature of air supplied to the burner lowers down the air density to fail to supply the sufficient and accurate amount of air required for combustion. Thus, the rate of oxygen of the air is lowered down to go beyond the a normal operation condition, causing a problem of attaining a reliability in a combustion controlling.

FIG. 4 is a graph showing a change in an air density according to a temperature change.

As shown in FIG. 4, the air density is rapidly dropped down at the temperature of 20° C.~100° C.

In addition, for a preferable combustion state, the gas supplied to the burner head 41 of the radiant burner 40 and a direction in which the air is injected are also critical factors.

Moreover, in the conventional the gas radiation oven range, the mixed gas pipe 44 is coupled at the side of the burner head 41 and its end is formed in a general tube shape, so that a mixed gas flowing inside the burner head 41 is inclined to one side and injected and thus the behavior of the mixed gas is not uniform.

DISCLOSURE OF THE INVENTION

Therefore, it is an object of the present invention to provide a combustion fan installation structure of a gas radiation oven range that is capable of improving a combustion performance of a gas radiation oven range and maintaining a better combustion form by supplying air with enough and uniform oxygen density in a gas radiation oven range having a combustion fan supplying air.

To achieve these objects, there is provided a combustion fan installation structure of a gas radiation oven range including: an outer case formed with its upper side opened and having an internal space which is sectioned to at least more than one space therein; a ceramic glass coupled to cover the outer case at the upper end, on which a foodstuff is placed to be cooked; a burner housing coupled to be in contact with a lower surface of the ceramic glass and forming an exhaustion passage together with the lower surface of the ceramic glass; a radiant burner coupled at one side of the burner housing and generating a radiant wave while burning a gas; a mixed gas pipe of which one end is coupled at one side of the radiant burner and the other end downwardly penetrating each section wall formed inside the outer case; a gas supply pipe coupled at one side of the mixed gas pipe; and a combustion fan positioned at some distance from the sectioned space of the uppermost part where the burner housing is coupled thereto and coupled to the other end of the mixed as pipe.

To achieve the above object, there is also provided a combustion fan installation structure of a gas radiation oven range including: a top burner unit with its upper side opened and having a burner assembly coupled therein; an outer case including a grill unit coupled at a lower side of a top case and performing a baking or roasting and an oven unit coupled at a lower side of the grill unit and performing a barbecue cooking; a ceramic glass coupled at the upper end of the top burner unit, covering it, on which a foodstuff is placed for cooking; a burner housing coupled to be in contact with the lower surface of the ceramic glass and forming an exhaust passage together with the lower surface of the ceramic glass; a radiant burner coupled at one side of the burner housing and generating a radiant wave while burning a gas; a mixing pipe of which one end is coupled at one side of the radiant burner and the other end downwardly penetrates the grill unit and an oven unit forming the outer case; a gas supply pipe coupled at one side of the mixing pipe; and a combustion fan positioned at some distance from the top burner unit where the burner housing is coupled and coupled to the other end of the mixing pipe.

To achieve the above object, there is also provided a combustion fan installation structure of a gas radiation oven range including: a top burner unit with its upper side opened and having a burner assembly coupled therein; an outer case including a grill unit coupled at a lower side of a top case and performing a baking or roasting and an oven unit coupled at a lower side of the grill unit and performing a barbecue cooking; a ceramic glass coupled at the upper end of the top burner unit, covering it, on which a foodstuff is placed for cooking; a burner housing coupled to be in contact with the lower surface of the ceramic glass and forming an exhaust passage together with the lower surface of the ceramic glass; a radiant burner coupled at one side of the burner housing and generating a radiant wave while burning a gas; and a combustion fan coupled at one side of the radiant burner, wherein the combustion fan is coupled at the oven unit at some distance from the top burner unit where the burner housing is positioned.

MODES FOR CARRYING OUT THE PREFERRED EMBODIMENTS

Figure 1:
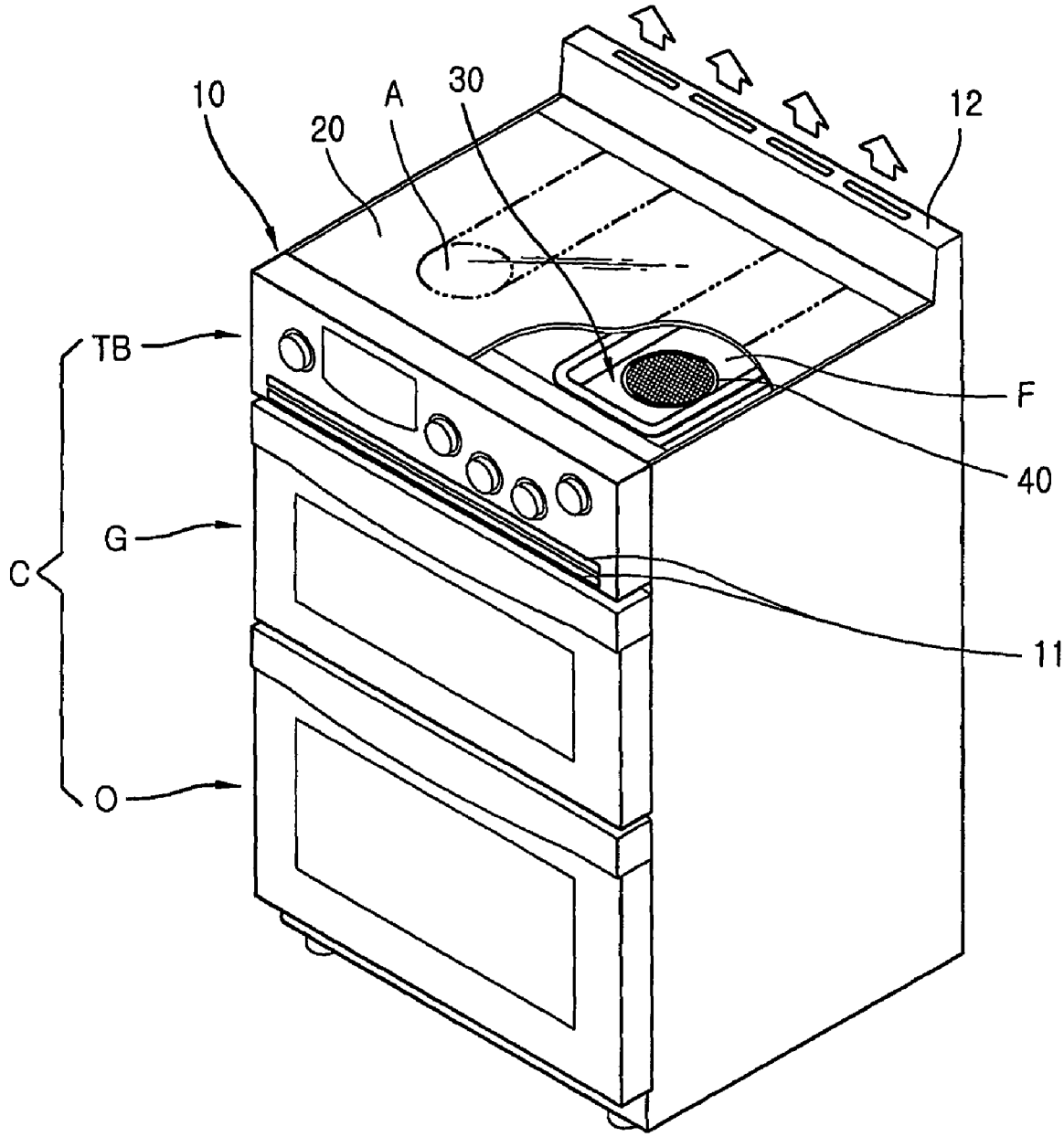
FIG. 1 is a perspective view showing an example of a gas radiation oven range in accordance with a conventional art.
Figure 2:
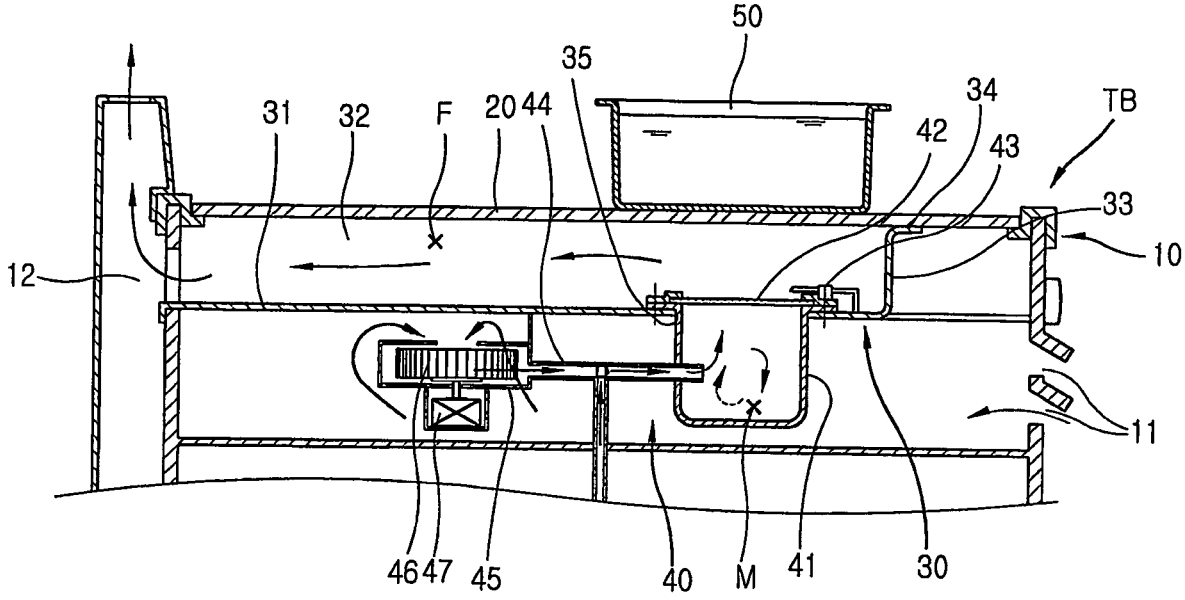
FIG. 2 is a sectional view showing a combination state of a combustion fan of the gas radiation oven range in accordance with the conventional art.
Figure 3:
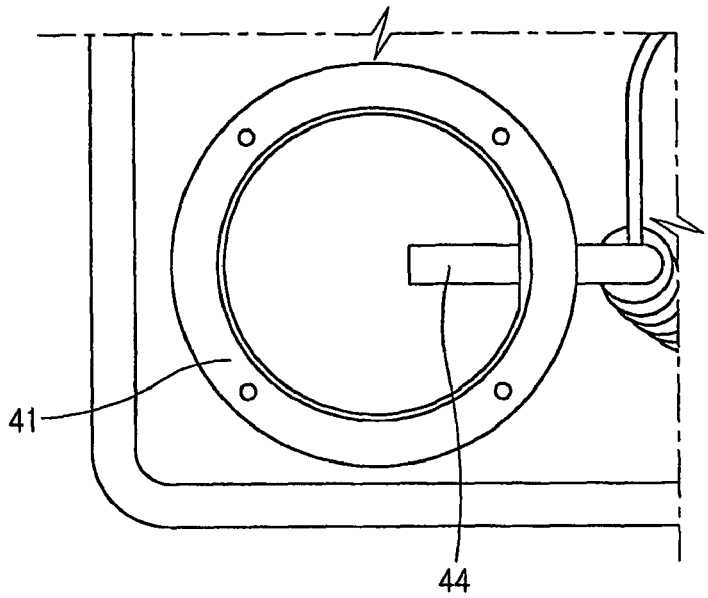
FIG. 3 is a plan view showing a gas mixing pipe of the gas radiation oven range in accordance with the conventional art.
Figure 4:
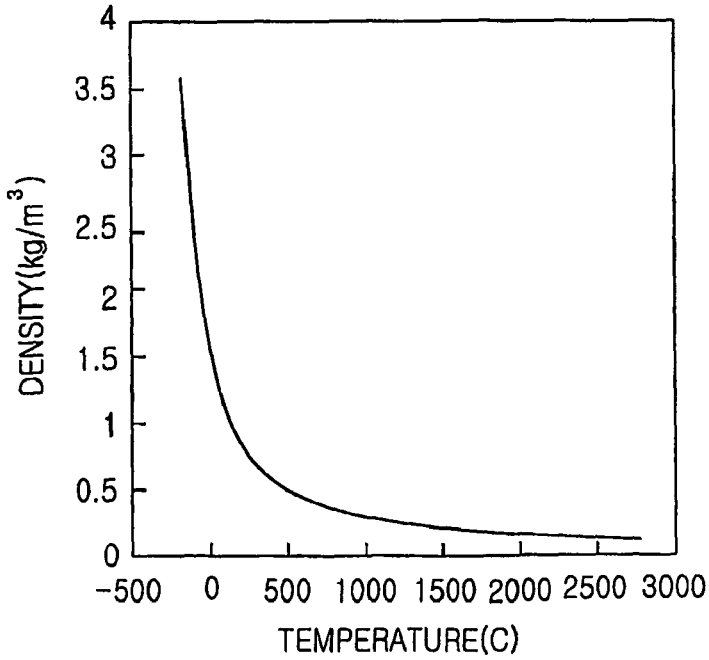
FIG. 4 is a graph showing a distribution of an air density according to a temperature state.

A combustion fan installation structure of a gas radiation oven range of the present invention will now be described in detail with reference to accompanying drawings.

The same reference numerals were given to the same elements as in the conventional art.

Figure 5:
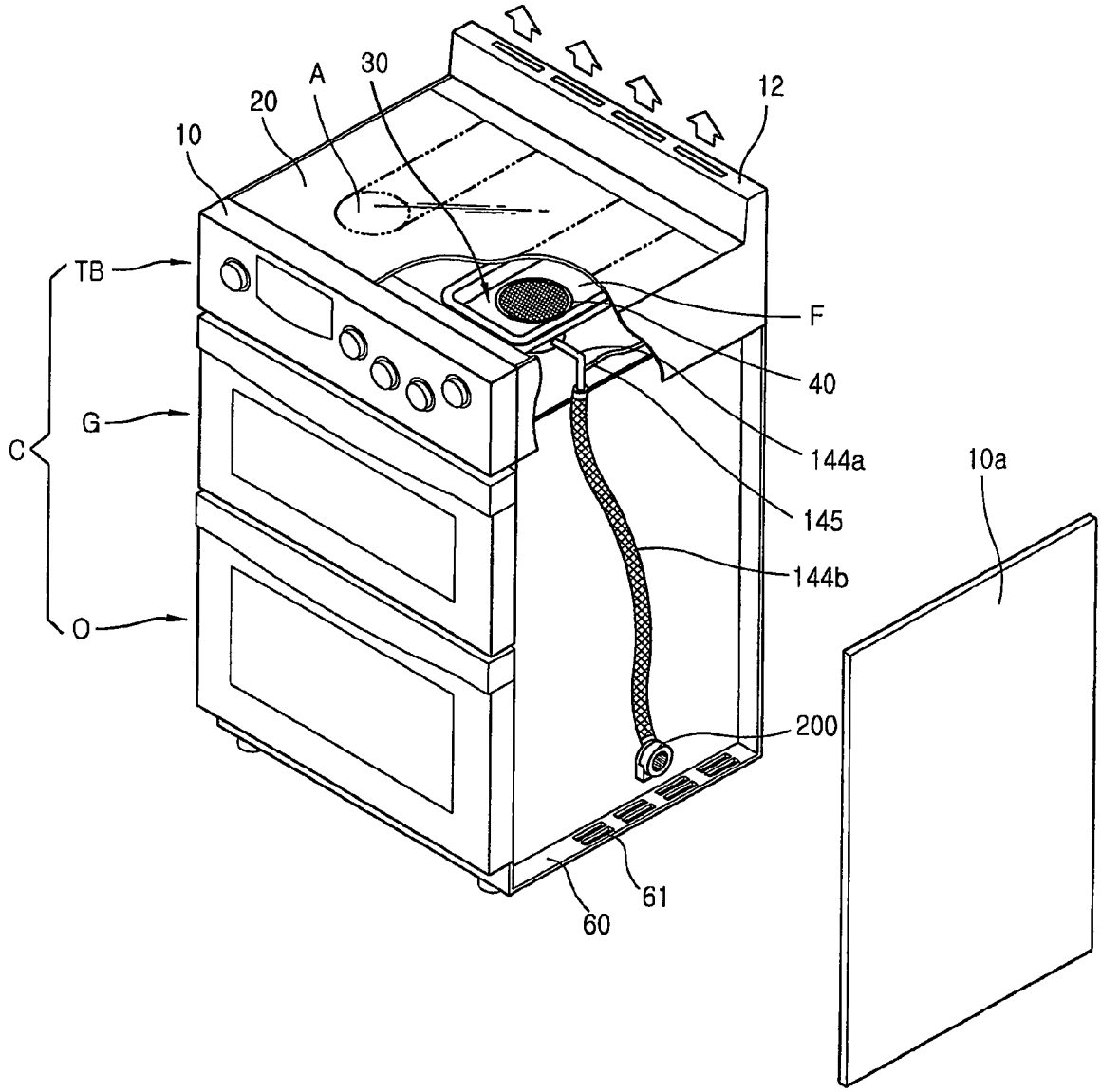
FIG. 5 is a perspective view showing a combustion fan installation structure of a gas radiation oven range in accordance with the present invention.
Figure 6:
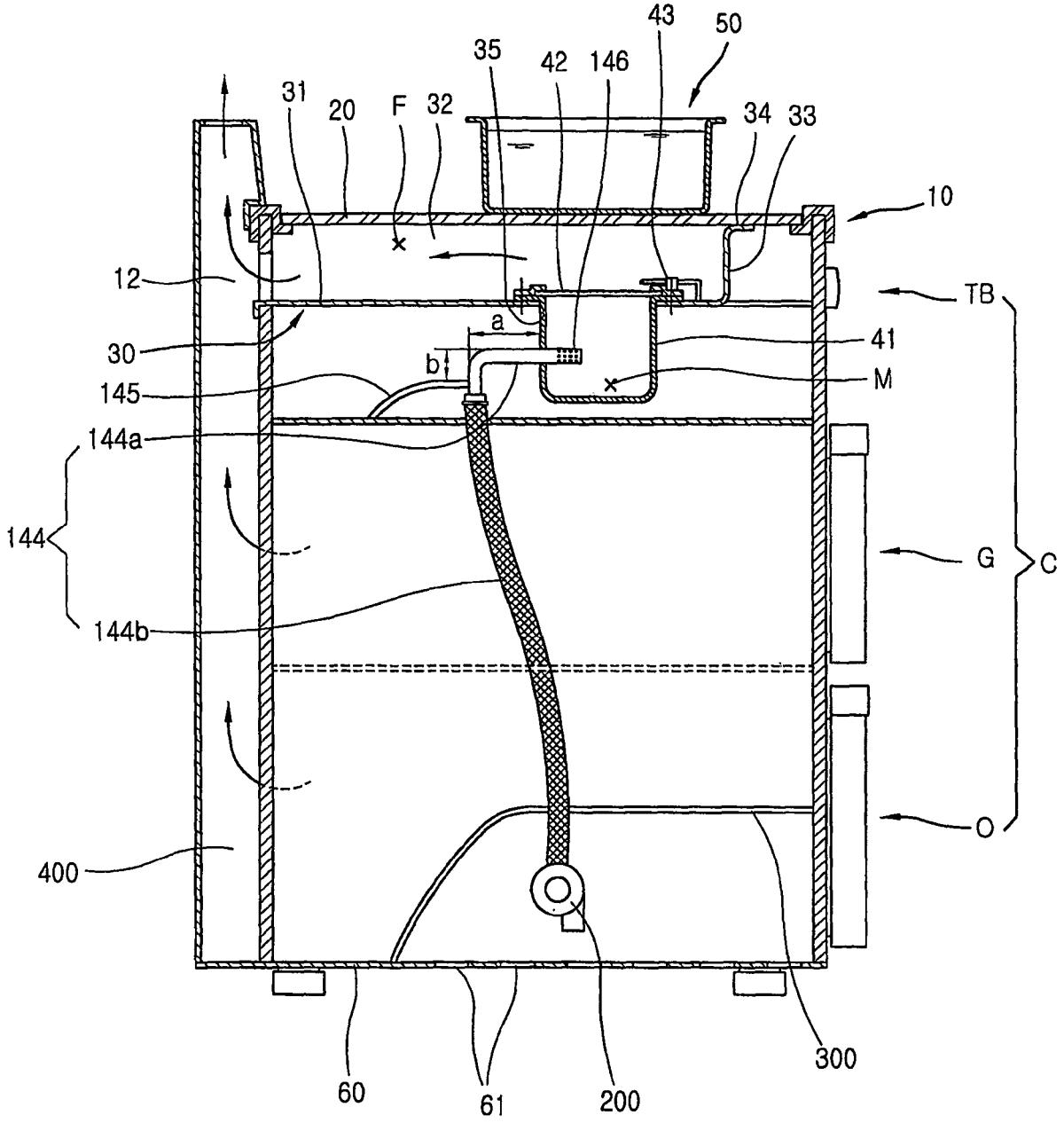
FIG. 6 is a vertical sectional view showing the combustion fan installation structure of a gas radiation oven range in accordance with the present invention.

As shown in FIGS. 5 and 6, in the combustion fan installation structure of a gas radiation oven range, a gas radiation oven range (C) is formed in a hexahedral shape, including a top burner unit (TB) in which a plurality of burners are coupled to heat a container with a foodstuff therein is installed at the top layer of the burner, a grill unit (G) for making baked foodstuffs by using heat convection installed at a lower side of the top burner unit (TB), and an oven unit (O) for cooking a barbecue cuisine by using a vertical fire power and heat convection installed at a lower side of the grill unit (G).

The top burner unit (TB) includes: an outer case 10 formed to have a certain internal space with its upper side opened; a ceramic glass 20 coupled at the upper side of the outer case 10 to cover it, on which a foodstuff is placed; a burner housing 30 coupled to be in contact with a lower surface of the ceramic glass 20 and forming an exhaust passage (F) together with the lower surface of the ceramic glass 20; and a radiant burner 40 coupled at one side of the burner housing 30 and generating a radiant wave while combusting a mixed gas.

The ceramic glass 20 is formed to have an area to cover the upper end of the outer case 10 and a certain thickness and made of a material that can transmit a radiant wave generated from the radiant burner 40.

A cooking area (A) is indicated at an upper side of the ceramic glass 20 so that a foodstuff can be placed at the position where the radiant wave radiated from the radiant burner 40 is transmitted.

As shown in FIGS. 5 and 6, the burner housing 30 includes: a lower plate unit 31 formed having a certain width and length; a side plate unit 32 bent and extended in a vertical direction at both sides of the lower plate unit 31; a connection plate unit 33 extended and bent so as to connect the both side plate unit 32 to one side of the lower plate unit 31; a coupling face unit 34 extended and bent in a horizontal direction from the end of the both side plate unit 32 and the connection plate unit 33 and having a certain area; and a mounting hole 35 penetratingly formed at one side of the lower plate unit 31 so as to be positioned at the side of the air suction hole 11 of the outer case 10 so that the radiant burner 40 can be mounted therein.

The connection plate unit 33 of the burner housing 30 is positioned at a front side of the outer case 10, and the opposite opened portion is positioned at the rear side of the outer case 10.

As the coupling face unit 34 is coupled being in contact with the lower surface of the ceramic glass 20, the exhaustion passage (F) for exhausting a combustion gas and the convection heat is formed together with the lower plate unit 31, the both side plate unit 32 and the lower surface of the ceramic glass 20.

The radiant burner 40 is fixedly coupled so that a burner head 41 forming a mixing chamber (M) is positioned at the mounting hole 35 of the burner housing 30.

A mixed gas pipe 144 is coupled at one side of the burner head 41, and a burner mat 42, a radiator for radiating a radiant wave, is fixedly coupled at an upper side of the burner head 41 so as to cover the mixing chamber (M) as the gas mixed in the mixing chamber (M) is belched, burned and heated.

An ignition and inflammation detecting unit 43 for igniting a mixed gas belched through the burner mat 42 and detecting a combustion state of the mixed gas is coupled at the lower plate unit 31 of the burner housing 30 so as to be adjacent to the burner mat 42.

As shown in FIG. 6, the mixed gas pipe 144 includes a coupling pipe 144*a* penetratingly coupled at one side of the radiant burner 41, of which one end is protruded inside the radiant burner 41; and a flexible air convey pipe 144*b* coupled at the end of the coupling pipe 144*a* and penetrating the grill unit (G) and the oven unit (O) formed at a lower portion of the outer case 10.

The end of the air convey pipe 144*b* is coupled at a combustion fan 200 formed as a motor and a fan are integrally coupled, and the combustion fan 200 is coupled at one side of the lowermost portion of the outer case 10.

A gas supply pipe 145 is coupled at one side of the mixed gas pipe 144 with certain distances (a) and (b) sufficient to form an uniform mixed gas.

Figure 7:
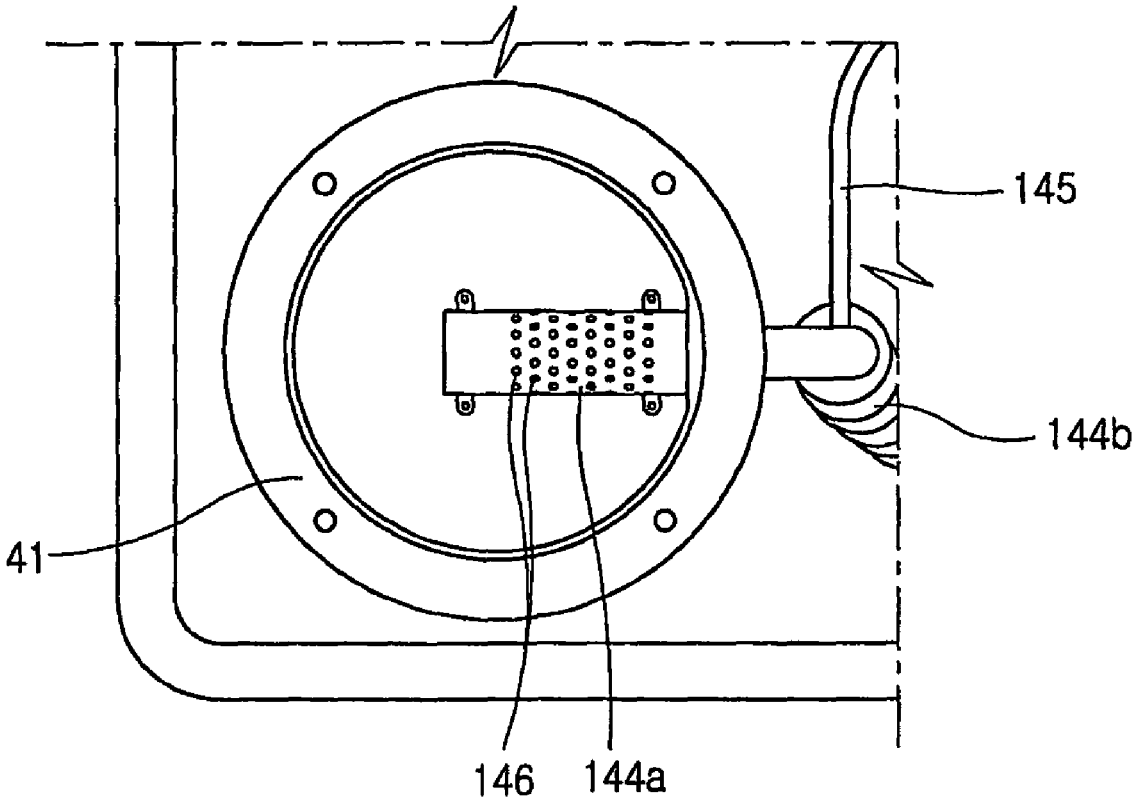
FIG. 7 is a plan view showing a mixing gas pipe of the combustion fan installation structure of a gas radiation oven range in accordance with the present invention.

As shown in FIG. 7, a plurality of injection holes 146 are formed at one side of the coupling pipe 144*a* of the mixed gas pipe 144 coupled protruded inside the radiant burner 40, in order to uniformly spray the mixed gas in every direction.

A plurality of suction holes 61 are formed at the bottom 60 of the outer case 10 to suck a low temperature air distributed at the lower portion of the burner.

The flexible air convey pipe 144*b* is made of insulated material in order to block a heat transmission from the ambient.

The mixed gas pipe 144 and the combustion fan 200 may be installed inside a cooling convey duct 400 formed to cool the exhaust gas discharged form the rear side of the outer case 10.

A separating plate 300 may be additionally formed to section a space at the lower side from the middle portion of the oven unit (O) at the side of the oven unit (O) positioned at the lowermost portion of the outer case 10, in order to maintain a low temperature air and pruniformt transmission of heat generated from the grill unit (G) and the oven unit (O) of the burner.

A reference numeral 10*a* is a cover to cover the side of the outer case 10.

The radiant burner may be constructed by including a plurality of assemblies formed by coupling the burner housing 30 and the radiant burner 40 according to its use and size.

The operation of the gas radiation oven range constructed as described above will now be explained.

First, a cooking container 50 with a foodstuff put therein is placed at a cooking area (A) of the ceramic glass 20 and the gas radiation oven range is operated. Then, as the combustion fan 200 is rotated, the low temperature air formed at the bottom of the space where the burner is placed is sucked through the suction holes 61 and introduced into the mixed gas pipe 144 through a fan housing (not shown) integrally coupled at the combustion fan 200. And, at the same time, a gas is supplied from the mixed gas pipe 144 from the gas supply pipe 145 coupled at one side of the mixed gas pipe 144 with the distances (a) and (b) from the radiant burner 40 and mixed with the air. The mixed air is discharged through the burner mat 42, and at the same time, ignited and burned by the ignition spark generated by the ignition and inflammation detecting unit 43.

At this time, as the mixed gas is discharged through the burner mat 42 and simultaneously burned, the burner mat 42 is heated so that a radiant wave is radiated from the burner mat 42. The radiant wave radiated from the burner mat 42 is transmitted through the ceramic glass 20 to heat the cooking container 50, thereby cooking the foodstuff put therein.

The combustion gas generated as the mixed gas is burnt and convection heat flow with a certain flow rate along the exhaust passage (F) formed by the ceramic glass 20 and the burner housing 30 and discharged outwardly of the gas radiation oven range through the exhaust port 12 formed at the rear side of the outer case 10.

INDUSTRIAL APPLICABILITY

As so far described, according to the combustion fan installation structure of a gas radiation oven range, since the temperature of the sucked air for combustion is constantly maintained, an air with a sufficient air density can be supplied. Thus, it can have a stable combustion performance.

In addition, a problem that an oxygen density in the air according to an influence of a temperature change of an inflow air generated when the oven or the grill is operated can be solved. Accordingly, a reliability of a combustion performance of the gas radiation oven range to be mainly used in kitchens or in hotels can be improved.

The invention claimed is:

1. A combustion fan installation structure of a gas radiation oven range comprising:

a top burner unit having an opened upper side and having a burner assembly coupled therein;

an outer case including a grill unit coupled at a lower side of a top case and an oven unit coupled at a lower side of the grill unit;

a ceramic glass coupled at the upper side of the top burner unit;

a burner housing located at a top portion of the outer case and coupled to be in contact with the lower surface of the ceramic glass and forming an exhaust passage together with the lower surface of the ceramic glass;

a cooling convey duct formed at a rear wall of the outer case to allow gases to flow therethrough, the cooling convey duct extending from a bottom end of the outer case up to and extending above a top surface of the ceramic glass, and the cooling convey duct having gas flow connectivity with the oven unit, with the grill unit, and with the exhaust passage below the ceramic glass;

a radiant burner coupled at one side of the burner housing and generating radiant heat;

a mixing pipe of which one end is coupled at one side of the radiant burner and the other end extends downwardly to be below the grill unit;

a gas supply pipe coupled at one side of the mixing pipe; and a combustion fan located at a bottom portion of the outer case at a side wall thereof and coupled to the other end of the mixing pipe, wherein a separation plate is additionally installed at the space formed at one side of the oven unit constituting the outer case to section the space and the combustion fan, and wherein the entire combustion fan is located below the one end of the mixing pipe, and the one end of the mixing pipe is higher than the other end of the mixing pipe, and wherein the combustion fan operates to induce air to flow into an intake vent formed at a bottom surface of the outer case, pass through the mixing pipe, in which air and gas are combined to form a mixed gas, and the mixed gas being provided to the radiant burner of the burner housing in which combustion of the mixed gas occurs, and whereby exhaust gases as a result of the combustion pass through the exhaust passage, and exit via the cooling convey duct.

2. The structure of claim 1, wherein the mixed gas pipe comprises:

a coupling pipe penetratingly coupled at one side of the radiant burner, of which one end is protruded into the radiant burner; and an air convey pipe coupled at the other end of the coupling pipe and penetratingly extended to a space at a bottom portion of the outer case.

3. The structure of claim 2, wherein the air convey pipe is made of a flexible material.

4. The structure of claim 2, wherein the coupling pipe coupled at the radiant burner includes a plurality of injection holes at a certain portion of the end protruded into the radiant burner.

5. The structure of claim 2, wherein the coupling pipe coupled at the radiant burner is formed downwardly by being bent more than once from a certain portion outside the radiant burner.

6. An apparatus comprising:

a body having a front wall, a rear wall that opposes the front wall, a first side wall, and a second side wall that opposes the front side wall;

an oven unit at a bottom portion of the body;

a grill unit at a middle portion of the body above the oven unit;

a ceramic cooking surface at a top portion of the body above the grill unit;

a cooling convey duct formed at the rear wall of the body to allow gases to flow therethrough, the cooling convey duct extending from a bottom end of the body up to and extending above the ceramic cooking surface, and the cooling convey duct having gas flow connectivity with the oven unit, with the grill unit, and with an exhaust passage below the ceramic cooking surface;

a radiant burner assembly below the ceramic cooking surface and under the exhaust passage;

a mixed gas pipe with a bent configuration having a first section extending horizontally into the radiant burner assembly and a second section perpendicular to the first section and extending towards the bottom end of the body;

a gas supply means connected to the second section of the mixed gas pipe to supply gas into the mixed gas pipe to allow forming of a mixed gas;

an exhaust vent, located at a top end of the cooling convey duct and facing in a direction opposite from the ceramic cooking surface, to allow exhaust gases to travel through the cooling convey duct and exhaust from the body away from the ceramic cooking surface;

an intake vent located at a bottom surface of the body at a lower end of the first side wall to receive air into the body; and a fan mechanism located by the first side wall and above the intake vent, the fan providing air to the radiant burner assembly via a flexible connector attached to the second section of the mixed gas pipe, wherein the fan mechanism operates to induce air to flow into the intake vent, pass through the flexible connector into the mixed gas pipe, in which air and gas are combined to form the mixed gas, and the mixed gas being provided into the radiant burner assembly in which combustion of the mixed gas occurs, and whereby exhaust gases as a result of the combustion pass through the exhaust passage, into the cooling convey duct, and out the exhaust vent.

7. The apparatus of claim 6, wherein for the mixed gas pipe, the first section has a first length and the second section has a second length, whereby the first and second lengths provide a sufficient distance along the mixed gas pipe to allow the mixed gas to be formed in a uniform manner.

8. The apparatus of claim 7, further comprising:

a separation plate formed at the first side wall to create a region around the fan mechanism to maintain a temperature near the fan mechanism by minimizing heat from being transferred from the oven unit, the grill unit, and the radiant burner assembly.

9. The apparatus of claim 8, wherein the separation plate has a curvature to match a shape of the fan mechanism.

* * * * *